United States Patent [19]

Schloss

[11] Patent Number: 4,685,642

[45] Date of Patent: Aug. 11, 1987

[54] ROTARY KITE

[76] Inventor: Alden Schloss, 4510 San Taela Ct., Woodland Hills, Calif. 91364

[21] Appl. No.: 917,492

[22] Filed: Oct. 10, 1986

Related U.S. Application Data

[63] Continuation of Ser. No. 565,759, Dec. 27, 1983, abandoned.

[51] Int. Cl.[4] ..... B64C 31/06

[52] U.S. Cl. ..... 244/153 A

[58] Field of Search ..... 440/8; 244/153 R, 153 A, 244/155 A

[56] References Cited

U.S. PATENT DOCUMENTS

| | | | |
|---|---|---|---|
| 297,215 | 4/1884 | Wood | 244/153 R |
| 464,412 | 12/1891 | Ansboro | 244/153 R |
| 966,143 | 8/1910 | Van Wie | 244/153 A |
| 2,524,500 | 10/1950 | Whitehurst | 244/153 R |
| 3,514,059 | 5/1970 | Aalto | 244/153 R |
| 4,113,209 | 9/1978 | Rodgers | 244/153 A |
| 4,276,033 | 6/1981 | Krovina | 440/8 |

FOREIGN PATENT DOCUMENTS

| | | | |
|---|---|---|---|
| 442109 | 7/1925 | Fed. Rep. of Germany | 244/153 R |
| 820412 | 4/1951 | Fed. Rep. of Germany | 244/153 A |

*Primary Examiner*—Joseph F. Peters, Jr.
*Assistant Examiner*—Rodney Corl

[57] ABSTRACT

A rotational kite using a plurality of sails derives both lifting force and rotational torque from the same sails. Rotation is useful in both stabilizing the kite and in providing a remarkable visual display. Construction is such that there is a minimum of deadweight; the structure efficiently contributes to the forces required for lifting and rotation.

4 Claims, 10 Drawing Figures

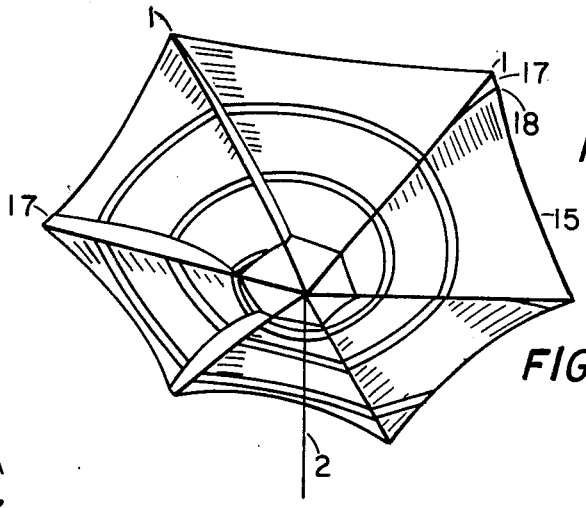
FIG. 1
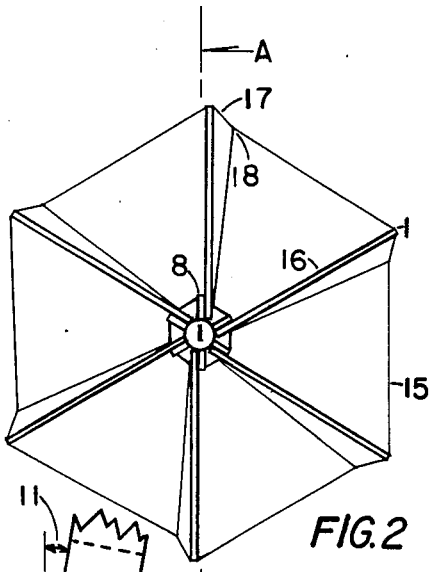
FIG. 2
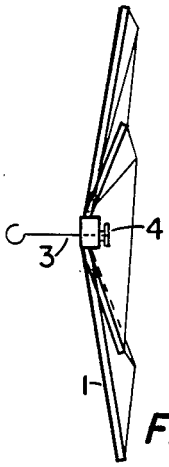
FIG. 3
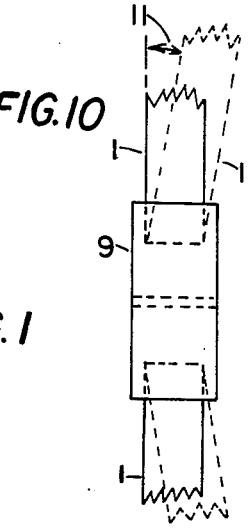
FIG. 10
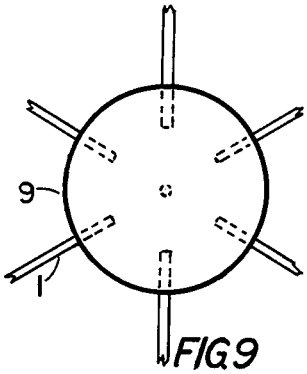
FIG. 9
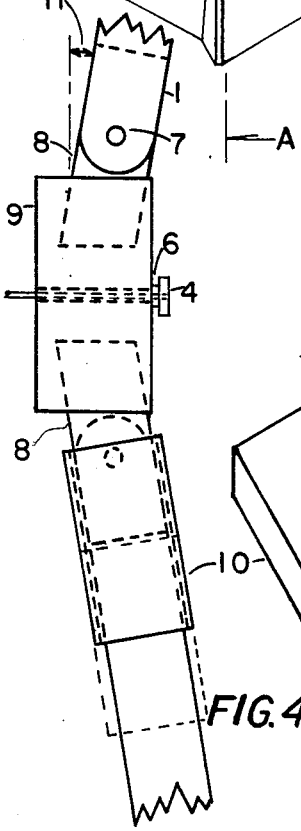
FIG. 4
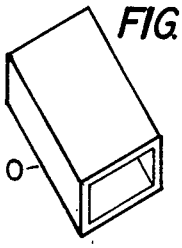
FIG. 5
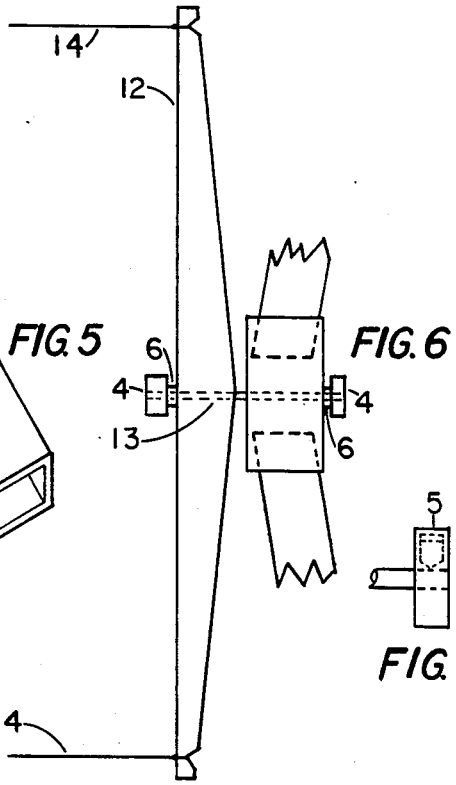
FIG. 6
FIG. 7
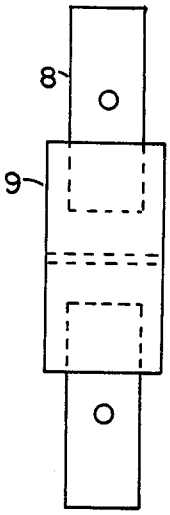
FIG. 8

ROTARY KITE

This application is a continuation of application Ser. No. 565,759, filed Dec. 27, 1983, now abandoned.

SUMMARY OF THE INVENTION

This invention relates to a variety of rotational kite. The kite uses a number of sails attached to masts. The masts are positioned so that they radiate at even angular increments from a central hub. The sails are triangular in shape. The luff of each sail is attached to a mast and a short sheet is connected from the foot-leach corner of each sail to the top (radially outermost end) of the neighboring mast. The head of the sail is toward the central hub. This arrangement allows for a maximum of projected sail area which contributes lift. The small angle each sail then makes with respect to a plane defined by two consecutive masts then provides the force necessary to produce rotational torque without unduly reducing the lift force. The hub has a central hole at right angle to the plane described by a circle drawn so that it contacts the top of each mast. A shaft is capped with a bearing surface which is placed on the leeward side of the hub. The shaft is placed in the hub hole. A separate bearing may be placed between the bearing surface and the hub. In one embodiment, the windward end of the shaft is bent into a hook to hold a flexible means (typically string) the other end of the flexible means is held by the operator to restrain the kite.

There are at least two devices in previous art which are similar in function but completely different in construct. Both of the devices suffer from excessive dead weight which will prevent flight in gentle breezes. The present invention maximizes lift area relative to the weight of the structure and so can fly in gentle breezes. The two kites alluded to have an inordinate number of rigid members which contribute weight yet have a relatively small amount of drag area which contributes to lift. The two inventions are: U.S. Pat. Nos. 4,113,209 and 3,086,738. The present kite will fly when the masts all lie in a plane perpendicular to the shaft. A refinement is made in a second species wherein the sails lie in a plane at a slight angle to such a plane. The small angle is obtained by rotating the top of each mast to leeward of the perpendicular plane. The angle is equivalent to the dihedral angle used in the wings of some airplanes. The dihedral angle stabilizes the kite. If a wind pertubation causes some masts to rotate to windward, the sails at that set of masts will have greater projected area presented to the wind, while the sails opposite will have less projected area. The result is a restoring torque to set the kite so that the sails are essentially at right angles to the wind.

There are two purposes for the rotation. The gyroscopic action of the rotating mass acts to stabilize the device. In addition, the rotation permits a visual display not possible in a non-rotating kite. A design such as a spiral placed on the sails will then give the appearance of ever spiraling outward (or inward) in the fashion of such designs used on barber poles. It is conceded that design alone is not a part of a utility patent, however the rotation inherent in the functioning of the kite allows the design to function which provides a remarkable sight thus enhancing the enjoyment of the kite.

Since there may be two stabilizing agents in the design of the kite, external stabilizers such as a tail are not needed.

For the purpose of control, a third species is presented. In this, a control rod is placed on the shaft just to leeward of a second bearing surface. A second bearing may be placed between the rod and second bearing surface. Two flexible means are attached to the ends of the rod and used to control flight by pulling one means more than the other, causing wind to spill from one side of the kite which results in manuevering.

Such a kite is desireable and useful. A strong interest is now evident in the public and the present invention will provide a different and interestingly new approach to kite flying.

A principle object of this invention is to provide a kite which rotates, and where the rotating portions are clearly visible from a great distance.

A further object of this invention is to so structure the necessary rigid members, that a high lift to weight ratio is obtained, enabling flying in gentle breezes.

A further object of this invention is to provide a rotating kite with enhanced stability due to both gyroscopic effects and to the effect of a dihedral angle.

A further object of this invention is to provide a rotating kite which is manueverable through the use of two flexible means.

The foregoing and other objects are realized in a device having a central hub which supports a plurality of spokes and masts. Each mast connects to a spoke and the spokes are anchored to the hub. Each mast carries a sail sheeted at an angle to provide both lift force and rotational torque. The masts may be positioned to provide a dihedral angle for stability. The foregoing objects are also realized in a simpler combination in which spokes are absent and the masts anchor directly to to the central hub. A better understanding can be had from the following description and accompanying drawings.

FIG. 1 is in perspective, showing the kite with single flexible means in flight;

FIG. 2 is a plan view showing six spokes six masts and sails in position;

FIG. 3 is a side view of FIG. 3 showing masts, sails hooked shaft and a bearing surface;

FIG. 4 is a section at A—A in FIG. 2 showing hub, spokes and folding mast detail;

FIG. 5 shows a rectangular sleeve used to lock masts to spokes;

FIG. 6 shows a side view of a control rod with shaft bearings and flexible means in place;

FIG. 7 is a detail showing how a bearing surface is attached to a shaft;

FIG. 8 shows a basic embodiment comprised of a hub and spokes;

FIG. 9 shows a basic embodiment without spokes where masts anchor directly to the hub and FIG. 10 shows a basic embodiment side view of FIG. 9 where masts are shown anchored with and without a dihedral angle.

The preferred embodiment is shown in FIG. one where a plurality of masts is labled 1. Any number of masts may be used; the larger the number the greater the lift area obtained for a given diameter but at increased cost of complexity and weight. Six masts prove to be about optimal with regard to maximizing the lift to weight ratio essential to flight capability at low wind velocities. Flexible means such as string is used by the operator to restrain the kite and is shown as 2 in FIG. one. In FIG. three, 3 is shaft terminating in a hook for attachment to flexible means. In the same FIG. (three) 4 is bearing surface attached to shaft 3. Attachment is typically made by a set screw shown as 5 in FIG. seven. In FIGS. six and four, 6 is a bearing made typically of some low friction material such as poly-tetra-flouroethylene. It could also be a small ball bearing such as used on propellor shafts of rubber powered model airplanes. (A separate bearing is not absolutely necessary, as the bearing surface itself can perform this function if it is made of a low friction material.) In FIG. four, 7 is a rivet (or other such fastening means as will allow rotational freedom). The rivet is used to attach each mast to a spoke (the plurality 8) which is anchored in the hub. Such riveting allows the mast to rotate to a folding position. (Folding is not absolutely essential to flight capability but IS essential to a practical commercial item which can be transported easily.) To fix the masts in position for flight, rectangular sleeve 10 (in FIGS. four and five) is positioned upward (in FIG. four) to lock mast(s) 1 to spoke(s) 8. Moving the sleeve (downward in FIG. four) to the position shown in dashed outline in FIG. four allows the the mast(s) to rotate to a folded position. The attached sails fold with the mast(s). Note in the embodiment shown in FIG. four there is a dihedral angle 11. The basic embodiment shown in FIG. eight has no dihedral angle. FIG. six shows a control arm 12 with a straight shaft 13. A bearing surface terminates the windward end of shaft 13 and is of the same construct as is the bearing surface 4 shown in FIG. seven. A bearing 6 may be placed between this surface and the control rod. Flexible means 14 attach to ends of control rod 12. Pulling on one means and relaxing the other will allow spilling the wind off one side and allow the kite to maneuver. Sails 15 are attached at their luff 16 to each mast. Sheets 17 connect from each luff-leach corner 18 to an adjoining mast. (Note, not all sheets are visible in the perspective view of FIG. one.) In the wind the sheets allow the sails to take an angle with respect to the rotational plane thus spilling some wind and causing reaction to generate rotational forces. FIG. nine shows a basic embodiment wherein mast(s) 1 anchor directly to hub 9. No spokes are used and the kite does not fold. In this basic embodiment the masts may or may not be set at a dihedral angle. FIG. 10 is a side view of FIG. nine and shows the masts either at no dihedral angle or at a dihedral angle as shown in dashed position. The various embodiments can be any combination of folding or non folding and with or without dihedral angle. The preferred embodiment is the combination of folding and with a dihedral angle. Minor variations which come within the scope of the appended claims shall be considered embraced therein.

What I claim is:

1. A rotary kite which is free to rotate while tethered by flexible means, said kite having a minimum of structural members consisting of a hub, a plurality of masts radiating from said hub, a plurality of sails attached to said plurality of masts, each of said plurality of sails being sheeted to an adjacent one of said plurality of masts with slack to allow wind spillage, and a shaft extending through said hub to allow attachment of said flexible means to constrain said kite.

2. A rotary kite as in claim 1 wherein said masts are set at a dihedral angle.

3. A rotary kite which is free to rotate while tethered by flexible means, said kite having a minimum of structural members consisting of a hub, a plurality of masts radiating from said hub, a plurality of sails attached to said plurality of masts, each of said plurality of sails being sheeted to an adjacent one of said plurality of masts with slack to allow wind spillage, a shaft extending through said hub, a control arm, said shaft extending through said control arm wherein said flexible means attaches to said control arm to constrain said kite.

4. A rotary kite as in claim 3 wherein said masts are set at a dihedral angle.

* * * * *